US006882812B2

(12) United States Patent
Kasahara et al.

(10) Patent No.: US 6,882,812 B2
(45) Date of Patent: Apr. 19, 2005

(54) IMAGE FORMING APPARATUS INCLUDING DEVELOPING DEVICE AND DEVELOPER CONTAINING DEVICE

(75) Inventors: Nobuo Kasahara, Yokohama (JP); Nobuo Iwata, Sagamihara (JP); Satoshi Muramatsu, Tokyo (JP); Junichi Matsumoto, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/367,949

(22) Filed: Feb. 19, 2003

(65) Prior Publication Data

US 2004/0161261 A1 Aug. 19, 2004

(30) Foreign Application Priority Data

Feb. 15, 2002 (JP) ..... 2002-039031

(51) Int. Cl.[7] ..... G03G 15/08
(52) U.S. Cl. ..... 399/120
(58) Field of Search ..... 399/119, 120, 399/27

(56) References Cited

U.S. PATENT DOCUMENTS

| | | | |
|---|---|---|---|
| 5,875,380 | A | 2/1999 | Iwata et al. |
| 5,953,567 | A | 9/1999 | Muramatsu et al. |
| 5,987,298 | A | 11/1999 | Muramatsu et al. |
| 6,112,046 | A | 8/2000 | Suzuki et al. |
| 6,128,459 | A | 10/2000 | Iwata et al. |
| 6,142,690 | A | 11/2000 | Yoshimura et al. |
| 6,163,669 | A | 12/2000 | Aoki et al. |
| 6,201,941 | B1 | 3/2001 | Kasahara et al. |
| 6,282,396 | B1 | 8/2001 | Iwata et al. |
| 6,295,437 | B1 | 9/2001 | Hodoshima et al. |
| 6,381,435 | B1 | 4/2002 | Shinohara et al. |
| 6,393,241 | B1 | 5/2002 | Matsumoto et al. |
| 6,507,720 | B1 | 1/2003 | Kabumoto et al. |
| 6,526,246 | B1 | 2/2003 | Iwata et al. |
| 6,542,707 | B1 | 4/2003 | Muramatsu et al. |

FOREIGN PATENT DOCUMENTS

| | | | | |
|---|---|---|---|---|
| JP | 51-13249 | | 2/1976 | |
| JP | 63-298370 | | 12/1988 | |
| JP | 4-353881 | | 12/1992 | |
| JP | 8-95382 | | 4/1996 | |
| JP | 9-166912 | | 6/1997 | |
| JP | 09166912 | A * | 6/1997 | ..... G03G/15/08 |
| JP | 9-218575 | | 8/1997 | |
| JP | 9-244376 | | 9/1997 | |
| JP | 11-212361 | | 8/1999 | |

* cited by examiner

*Primary Examiner*—Quana Grainger
(74) *Attorney, Agent, or Firm*—Oblon, Spivak, McClelland, Maier & Neustadt, P.C.

(57) ABSTRACT

An image forming apparatus includes a main body. The apparatus includes an image carrier, a developing device, a cleaning device that removes a waste toner on the image carrier, a developer supply device that supplies a developer to the developing device, a developer discharging device that discharges an excess developer from the developing device, and a developer containing device. The developer containing device includes an opening facing the developer supply device, a developer storing section that stores the developer supplied to the developer supply device through the opening, and a waste developer storing section that stores the excess developer and waste toner. The developer containing device is detachably attached to the main body of the image forming apparatus, and when the developer containing device is detached from the main body for replacement, the waste developer storing section is detached from the main body together with the developer containing device.

12 Claims, 7 Drawing Sheets

IMAGE FORMING APPARATUS INCLUDING DEVELOPING DEVICE AND DEVELOPER CONTAINING DEVICE

CROSS-REFERENCE TO RELATED APPLICATIONS

The present application claims priority to Japanese Patent Application No. 2002-039031 filed in the Japanese Patent Office on Feb. 15, 2002, the disclosure of which is incorporated herein by reference.

BACKGROUND OF THE INVENTION

1. Field of the Invention

The present invention relates to an image forming apparatus including a developing device such as a copying machine, a printer, a facsimile machine, or other similar image forming apparatus in which a premixed developer, i.e., a two-component developer including a mixture of toner and carrier is supplied to the developing device.

2. Discussion of the Background

There are, for example, two methods of supplying toner to a developing device in an image forming apparatus using a two-component developer for development: (1) a method of supplying toner to a developing device to make up consumed toner for development, and (2) a method of supplying toner and carrier to a developing device even though only toner is consumed for development. In the above method (1) of supplying toner, carrier particles get deteriorated by friction generated between the carrier particles while being agitated with toner in the developing device, resulting in carrier particles being crushed, and breakage of a coating film on the surface of the carrier particles. In addition, a charging amount of toner is increased by the friction between the carrier particles, so that the toner is not easily adhered to an image portion. As a result, the developing ability of the developer greatly decreases.

On the other hand, in the above method (2) of supplying toner and carrier, an excess developer in a developing device accommodating an excessive amount of developer due to the supply of toner and carrier is discharged from the developing device. The deteriorated developer in the developing device can be replaced with a fresh developer by repeating the developer supply and discharging operations. Therefore, the deterioration of carrier can be suppressed.

With regard to a background technique for suppressing the deterioration of carrier in a two-component developer, Japanese Laid-open patent publication No. 51-13249 describes an electrophotographic developing device including a detecting device that detects a ratio of carrier and toner in a developer in a developing section, a carrier supplying device that supplies a predetermined amount of carrier to the developing section based on a predetermined developing time or a predetermined copy volume, and a toner supplying device that supplies toner to the developing section. The toner is supplied to the developing section based on a detection result of the detecting device, and at least a predetermined amount of developer is discharged from the developing section.

Further, Japanese Laid-open patent publication No. 4-353881 describes a developing device including a housing that accommodates a two-component developer to be supplied to a developer carrier, a discharging device that discharges a premixed additional two-component developer into the housing, and a detecting device that detects an amount of the developer in the housing. The housing includes an exit port from which the developer is expelled. When the detection value detected by the detecting device equals a predetermined value or more, the amount of the developer in the housing is reduced by expelling the developer from the exit port.

According to the above-described two background techniques, an excess developer in a developing device is adequately discharged therefrom. As a result, the decrease of developing ability of the developer caused by the deterioration of carrier can be prevented.

In the above-described two background techniques, both toner and carrier are supplied to the developing section. Specifically, in the developing device described in JP publication No. 4-353881, a premixed developer including a mixture of toner and carrier is supplied into the housing. In the electrophotographic developing device described in JP publication No. 51-13249, toner and carrier are independently supplied to the developing section without being premixed. Therefore, the constructions of the developer supplying devices that supply a developer into a housing or a developing section differ between the developing device described in JP publication No. 4-353881 and the electrophotographic developing device described in JP publication No. 51-13249.

Specifically, the developing device described in JP publication No. 4-353881 includes only one developer supplying device that supplies the developer into the housing. The electrophotographic developing device described in JP publication No. 51-13249 includes two developer supplying devices, such as, a carrier supplying device and a toner supplying device. Thus, in the electrophotographic developing device described in JP publication No. 51-13249, the construction of the developing device becomes complicated, and the size and cost of the developing device increases as compared to the developing device using a premixed developer. Therefore, an image forming apparatus using a premixed developer supplied to a developing device has an advantage in practicality.

In an image forming apparatus, a residual toner remaining on a surface of an image carrier after a toner image is transferred from the image carrier to a transfer material has to be removed from the surface of the image carrier as a waste toner prior to a subsequent image forming operation. Such a waste toner needs to be discharged from the main body of the image forming apparatus.

With regard to a background technique for removing residual toner on an image carrier, Japanese Laid-open patent publication No. 63-298370 describes a toner cartridge including a volume ratio changing device which changes each volume ratio of a toner storing section and a toner collecting section. Specifically, after supplying toner to a developing device, the volume of the toner collecting section is changed to be greater than that of the toner storing section. The toner collecting section is used for accommodating waste toner. This construction allows an excess space in the toner storing section increased by supplying toner in the toner storing section to the developing device to be diverted to the waste toner collecting section. Therefore, as compared to a developing device in which each predetermined volume is secured for a toner storing section and a toner collecting section, the entire volume of the developing device does not increase, and a mixture of waste toner and fresh toner can be surely prevented.

In the image forming apparatus using a premixed developer to be supplied to a developing device, not only a residual toner removed from an image carrier but also an excess developer in a developing unit needs to be disposed of. In this case, because operations for discharging both the residual toner and excess developer from the main body of the image forming apparatus are necessary, the operation of the image forming apparatus is frequently stopped due to the disposal operation for the residual toner and excess developer, thereby causing downtime of the image forming apparatus. As the downtime of the image forming apparatus increases, the reliability of the apparatus decreases.

In the above-described developing device described in JP Publication No. 4-353881, it is necessary to provide a discharging device for discharging the developer and an excess developer container for containing the discharged excess developer. In addition, the image forming apparatus using the above developing device needs to include a waste toner container that contains the waste toner removed from the surface of an image carrier. When discharging the excess developer and waste toner from the excess developer container and waste toner container, respectively, the disposal operations need to be performed independently. Therefore, an operation time for discharging the excess developer and waste toner from the main body of the image forming apparatus is necessary, resulting in downtime of the image forming apparatus.

For example, Japanese Laid-open patent publication Nos. 9-218575 and 9-244376 describe developing devices for use in an image forming apparatuses in which an excess developer is efficiently discharged from the main body of the image forming apparatus to be disposed of. The above-described developing devices are configured so that a developer cartridge includes respective containing sections for an additional supply developer and an excess developer. In this configuration, when the developer cartridge is replaced with a new developer cartridge after all the additional supply developer in the containing section is consumed, the disposal of the excess developer is performed at the same time. In this case, an exclusive operation time for the disposal of the excess developer is eliminated, thereby preventing the downtime of an image forming apparatus caused by the disposal of the excess developer.

However, the image forming apparatus including the above developing device needs to include a waste toner container. Therefore, an exclusive operation time for the disposal of the waste toner is necessary, thereby causing the downtime of the image forming apparatus.

Further, Japanese Laid-open patent publication No. 11-212361 describes an image forming apparatus including a developing device in which an excess developer and waste toner are collected and stored in one collecting chamber. The collecting chamber is configured to be detachably attached to the main body of the image forming apparatus. In this image forming apparatus, the excess developer and waste toner can be disposed of at the same time by detaching the collecting chamber from the main body of the image forming apparatus.

However, the above-described image forming apparatus needs to perform a sequential operation for detaching the collecting chamber from the main body of the image forming apparatus, disposing of the excess developer and waste toner in the collecting chamber, and attaching the detached collecting chamber to the main body of the image forming apparatus.

Such a sequential operation is performed independently from a supplying operation of a fresh developer to the image forming apparatus, thereby causing downtime of the image forming apparatus.

SUMMARY OF THE INVENTION

Accordingly, one object of the present invention is to provide an image forming apparatus including a developing device using a premixed developer in which the downtime of the apparatus caused by the exclusive disposal operation for an excess developer and waste toner is eliminated.

To achieve these and other objects, the present invention provides an image forming apparatus including a main body. The apparatus includes an image carrier configured to carry a latent image on a surface of the image carrier, and a developing device configured to develop the latent image on the image carrier with a developer including toner and carrier and to form a toner image on the surface of the image carrier. Also included is a transfer device configured to transfer the toner image from the image carrier to a transfer material, and a cleaning device configured to remove a waste toner remaining on the surface of the image carrier after the toner image is transferred from the image carrier to the transfer material by the transfer device.

The image forming apparatus further includes a developer supply device configured to supply the developer to the developing device, a developer discharging device configured to discharge an excess developer from the developing device, and a developer containing device configured to contain the developer to be supplied to the developing device by the developer supply device. Further, the developer containing device includes an opening facing the developer supply device, a developer storing section configured to store the developer supplied to the developer supply device through the opening, and a waste developer storing section configured to store the excess developer discharged from the developing device by the developer discharging device and to store the waste toner removed from the surface of the image carrier by the cleaning device. At least the image carrier, the developing device, the developer supply device, and the developer containing device are positioned substantially parallel to each other, and the developer containing device is detachably attached to the main body of the image forming apparatus. When the developer containing device is detached from the main body of the image forming apparatus for replacement of the developer containing device by a new developer containing device, the waste developer storing section is configured to be detached from the main body of the image forming apparatus together with the developer containing device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
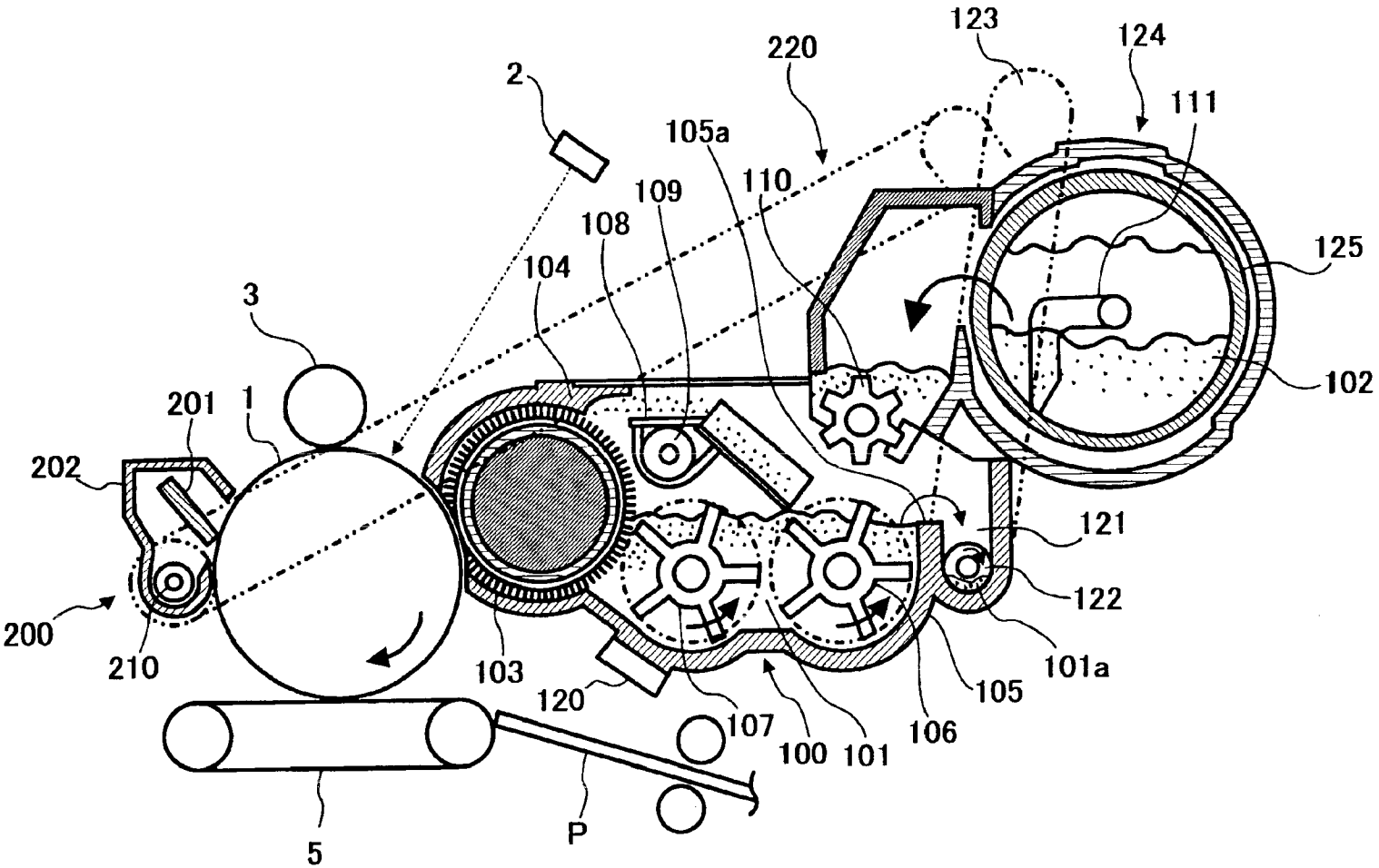
FIG. 1 is a schematic view of an image forming section of an image forming apparatus according to one embodiment of the present invention.

Preferred embodiments of the present invention are described in detail referring to the drawings, wherein like reference numerals designate identical or corresponding parts throughout the several views.

FIG. 1 is a schematic view of an image forming section of an image forming apparatus according to one embodiment of the present invention. Image forming operations of the image forming apparatus are performed by a known electrophotographic image forming process.

Referring to FIG. 1, a surface of a photoconductive drum 1 serving as an image carrier is uniformly charged by a charging device 3. An exposure device 2 irradiates the charged surface of the photoconductive drum 1 with a laser beam corresponding to an image of an original document, thereby forming an electrophotographic latent image on the photoconductive drum 1. A developing device 100 develops the electrophotographic latent image on the photoconductive drum 1 with toner, and forms a toner image. The toner image is transferred from the photoconductive drum 1 to a transfer sheet (P) by a transfer device 5.

Subsequently, a transferred toner image is fixed onto the transfer sheet (P) in a fixing device (not shown). The transfer sheet (P) carrying a fixed image is discharged from a main body of the image forming apparatus and is stacked on a tray as a copy or print sheet. After the toner image is transferred from the photoconductive drum 1 to the transfer sheet (P), a cleaning device 200 removes foreign substances such as toner and paper powder from the surface of the photoconductive drum 1. Subsequently, the surface of the photoconductive drum 1 is uniformly discharged by a discharging device (not shown) to be prepared for a next image forming process.

In this embodiment, the developing device 100 employs a developing method using a two-component developer 101 including toner and carrier. With regard to the mixture ratio of toner to carrier in the developer 101, the developer 101 contains 1.5 through 5.0% toner by weight. Like the developer 101, a supply developer 102 as a premixed developer which is replenished from a developer supply container 124 to the developing device 100 includes toner and carrier. With regard to the mixture ratio of toner to carrier in the supply developer 102, the supply developer 102 contains 70 through 90% toner by weight.

A developing roller 103 includes magnets inside thereof. The developer 101 supplied to a surface of the developing roller 103 is regulated by a developer regulating member 104 such as a doctor blade to maintain the developer 101 at an adequate amount.

In a developer housing 105 of the developing device 100, the developer 101 is conveyed to the developing roller 103 while being agitated by agitating members 106 and 107, and is circulated in the developer housing 105 by a developer guide member 108 and a developer conveying screw 109. Further, a developer density detector 120 detects the density of the developer 101 (i.e., a mixture ratio of toner and carrier). As the developer density detector 120, for example, a detector which detects the magnetic permeability of the developer 101 is used.

Figure 3:
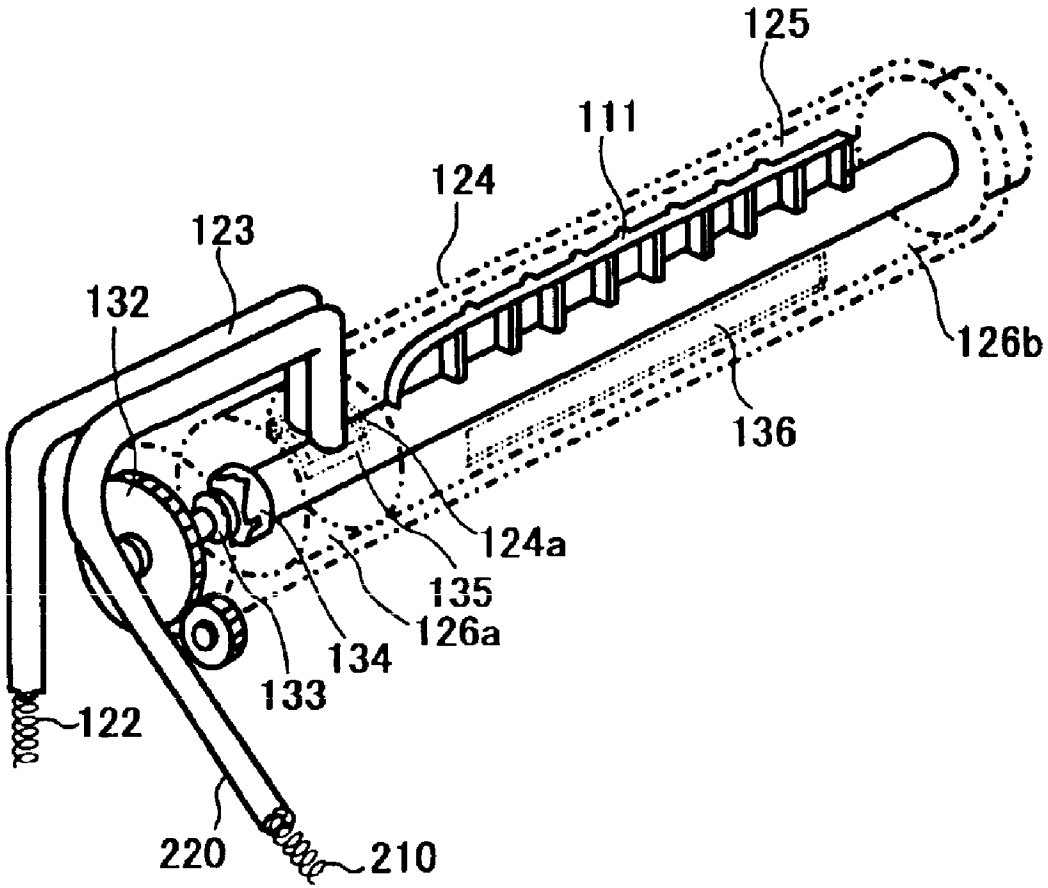
FIG. 3 is a perspective view of an interior of a developer cartridge.

Referring to FIG. 1, when the density of the developer 101 in the developer housing 105 is decreased after image forming operations are performed a plurality of times, the supply developer 102 is supplied into the developer housing 105. As illustrated in FIG. 3, the supply developer 102 is stored in a supply developer storing section 126*b* formed at a part of a developer cartridge 125 serving as a developer containing device in the developer supply container 124. The supply developer 102 stored in the supply developer storing section 126*b* is conveyed to a developer supply member 110 while being agitated by a supply developer conveying/agitating member 111. A predetermined amount of the supply developer 102 is supplied into the developer housing 105 by rotating the developer supply member 110 by a drive motor (not shown), and thereby the density of the developer 101 is maintained at a predetermined value.

In the above-described image forming apparatus using the premixed two-component developer, as described earlier, as image forming operations are repeatedly performed, the contents of the carrier in the developer 101 in the developer housing 105 gradually increase. This is because the toner in the developer 101 accommodated in the developer housing 105 is gradually used for developing an electrophotographic latent image formed on the photoconductive drum 1. When the image forming operations continue to be performed under the condition in which the content of the carrier in the developer 101 is high in the developer housing 105, the carrier in the developer 101 gradually fatigues. As a result, problems such as toner filming, crushing, and breakage of a coating film on the surface of the carrier, typically occur. In addition, because the mixture ratio of the toner and carrier in the developer 101 in the developing device 100 changes, i.e., the ratio of carrier is greater than that of toner, the developing ability of the developer 101 is greatly deteriorated.

The developing ability of the developer 101 in the developing device 100 can be maintained at a predetermined level by discharging the increased carrier from the developer housing 105 at an appropriate timing and by supplying the supply developer 102 as fresh developer to the developing device 100. Therefore, in the present embodiment, it is constructed that the excess developer 101 having an inferior developing ability is surely discharged from the developer housing 105 of the developing device 100.

Specifically, as illustrated in FIG. 1, a partition 105*a* functioning as a developer height regulating member is provided at a part of the developer housing 105. With the provision of the partition 105*a*, when the amount of the developer 101 with the fresh supply developer 102 in the developer housing 105 increases, the excess (fatigued) developer 101*a* climbs over the partition 105*a* and is overflowed into a developer collecting section 121.

To dispose of the excess developer 101*a* discharged from the developer housing 105 and of the waste toner removed from the surface of the photoconductive drum 1, an operation time for disposal is necessary. Such an operation time for disposal results in a downtime of the image forming apparatus in which the operation of the image forming apparatus stops. Therefore, in the present embodiment, the image forming apparatus includes a construction which allows the image forming apparatus to dispose of the excess developer 101*a* and the waste toner without having a downtime. The features of such a construction will be described hereinafter.

Referring to FIG. 3, the excess developer 101*a*, that spilled over the partition 105*a* is stored in a waste developer storing section 126*a* formed at a part of the developer cartridge 125. The waste developer storing section 126*a* stores the excess developer 101*a* and the waste toner removed from the surface of the photoconductive drum 1 by the cleaning device 200. The excess developer 101*a* is conveyed from the developer collecting section 121 toward the waste developer storing section 126*a* by an excess developer conveying device including an excess developer discharging screw 122 as a developer discharging device provided in the developer collecting section 121, and an excess developer conveying path 123. The excess developer 101*a* enters the developer cartridge 125 through an inlet 124*a* provided in the developer supply container 124.

The cleaning device 200 removes foreign substances, such as the residual toner remaining on the surface of the photoconductive drum 1 after the toner image is transferred from the photoconductive drum 1 to a transfer sheet (P) by the transfer device 5, and paper powder. The cleaning device 200 includes a cleaning blade 201 and a foreign substance holding unit 202. A leading edge of the cleaning blade 201 abuts against the surface of the photoconductive drum 1 to scrape the foreign substances off the photoconductive drum 1. The scraped foreign substances (hereafter referred to as waste toner) fall toward the bottom part of the foreign substance holding unit 202. The waste toner is also stored in the waste developer storing section 126*a* formed at the part of the developer cartridge 125. As illustrated in FIGS. 1 and 3, the waste toner is conveyed from the cleaning device 200 toward the waste developer storing section 126*a* by a waste toner conveying device including a waste toner discharging screw 210 provided in the cleaning device 200, and a waste toner conveying path 220. The waste toner enters the developer cartridge 125 through the inlet 124*a* provided in the developer supply container 124.

Figure 2:
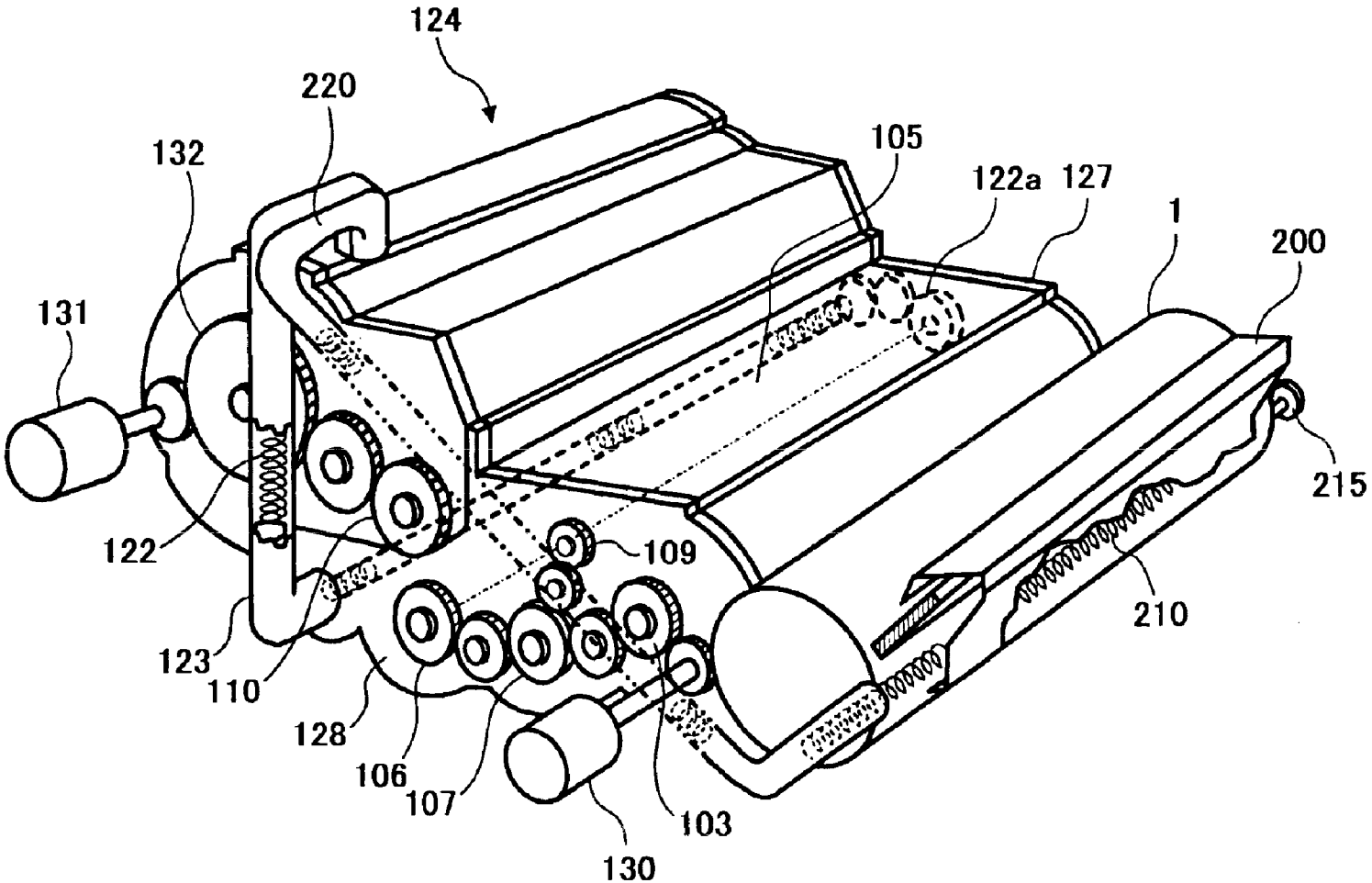
FIG. 2 is a perspective view of a part of the image forming section of the image forming apparatus of FIG. 1.

As illustrated in FIG. 2, the elements of the developing device 100 are supported by the developer housing 105, and side plates 127 and 128. The developing roller 103, the developer agitating members 106 and 107, and the developer conveying screw 109 are rotatably supported between the side plates 127 and 128. The developing roller 103, the developer agitating members 106 and 107, and the developer conveying screw 109 are connected to each other via gears such that the developing roller 103, the developer agitating members 106 and 107, and the developer conveying screw 109 are cooperatively rotated by a drive motor 130.

As illustrated in FIG. 2, the developer replenishing member 110 and the developer conveying and agitating member 111 (illustrated in FIG. 1) are driven by a motor 131 via a drive gear 132 and other gears engaged with the drive gear 132. As illustrated in FIGS. 1 and 3, the developer conveying and agitating member 111 is disposed in the supply developer storing section 126*b* in the developer cartridge 125. Referring to FIG. 2, when the drive gear 132 is rotated by the motor 131, a drive coupling 133 (illustrated in FIG. 3) coaxially provided with the drive gear 132 is driven, thereby driving a driven coupling 134 (illustrated in FIG. 3) provided on the one end part of the developer conveying and agitating member 111 and engaged with the drive coupling 133, and rotating the developer conveying and agitating member 111 in a direction of supplying the supply developer 102 to the developer supply member 110.

The excess developer discharging screw 122 is driven via gear trains 122*a* (illustrated in FIG. 2) arranged on the one end surface of the developer agitating member 106, i.e., an outer surface of the side plate 127. The excess developer discharging screw 122 may be driven by an exclusive-use motor. The excess developer discharging screw 122 is rotatably provided in the excess developer conveying path 123. The excess (fatigued) developer 101*a* is conveyed in the excess developer conveying path 123 by the rotation of the excess developer discharging screw 122.

The waste toner discharging screw 210 is driven via a gear 215 (illustrated in FIG. 2) arranged on the one end surface of the cleaning device 200 and connected to a gear provided on the end portion of the photoconductive drum 1. The waste toner discharging screw 210 may be driven by an exclusive-use motor. The waste toner discharging screw 210 is rotatably provided in the waste toner conveying path 220. The waste toner is conveyed in the waste toner conveying path 220 by the rotation of the waste toner discharging screw 210.

Figure 4:
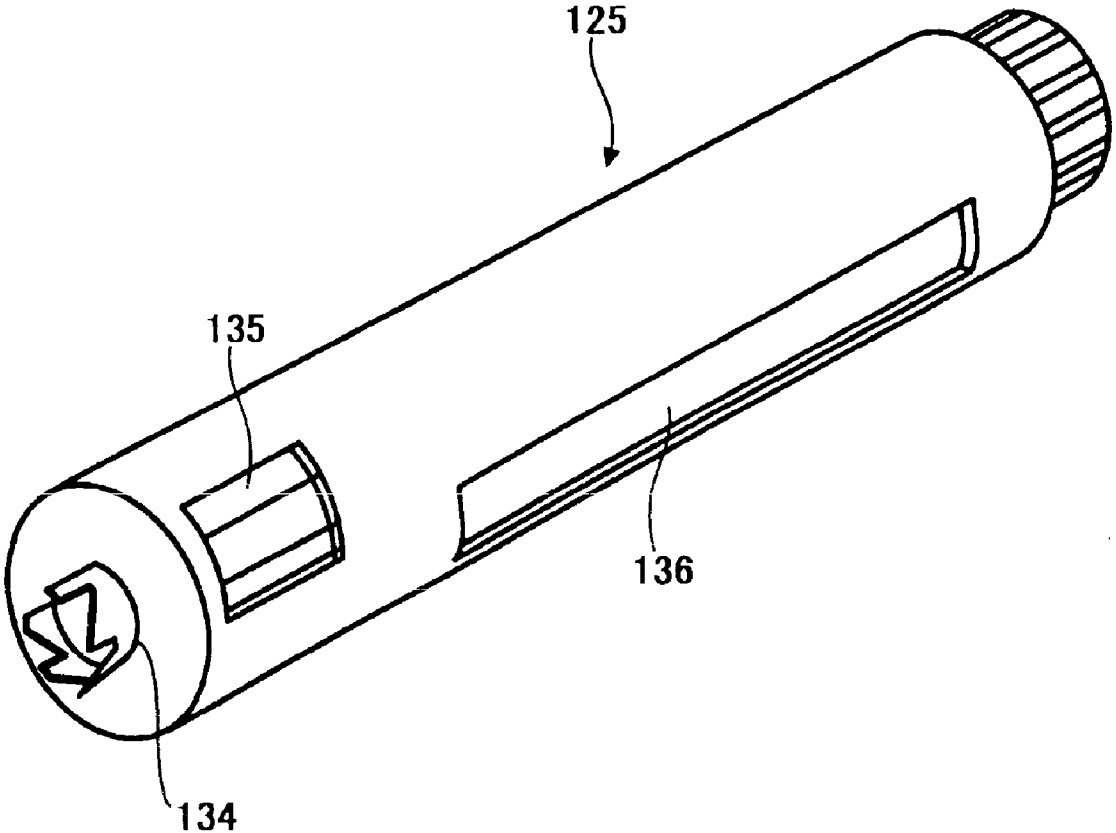
FIG. 4 is a perspective view of the developer cartridge of FIG. 3.
Figure 5:
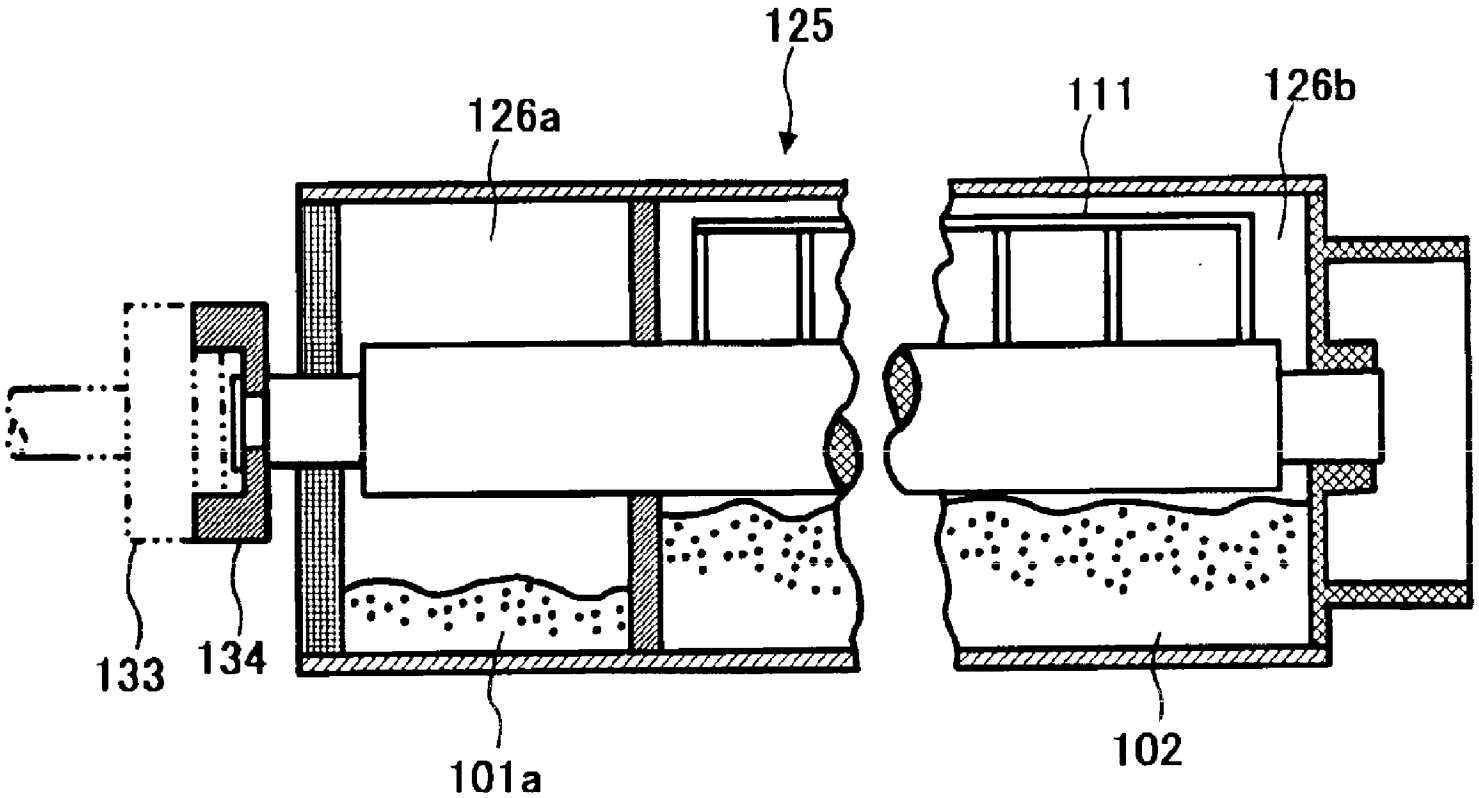
FIG. 5 is a plan view of the interior of the developer cartridge of FIG. 3.

As illustrated in FIG. 5, the developer cartridge 125 is integrally constructed with the waste developer storing section 126*a* and the supply developer storing section 126*b* that stores the supply developer 102. The developer conveying and agitating member 111 is provided in the supply developer storing section 126*b*. In addition, as illustrated in FIG. 4, two openings are formed in an outer circumferential surface of the developer cartridge 125. Specifically, one is an opening 135 communicated to the waste developer storing section 126*a*, and the other is an opening 136 communicated to the supply developer storing section 126*b*.

With the above-described construction, the excess (fatigued) developer 101*a* spilled over the partition 105*a* is conveyed and stored in the waste developer storing section 126*a* in the developer cartridge 125. Specifically, the excess developer 101*a* is conveyed by the excess developer discharging screw 122 in the excess developer conveying path 123, and is then stored in the waste developer storing section 126*a* through the opening 124*a* provided in the developer supply container 124 and through the opening 135 communicated to the waste developer storing section 126*a*.

Further, as described above, the waste toner removed from the surface of the photoconductive drum 1 is conveyed and stored in the waste developer storing section 126*a* as well. Specifically, the waste toner is conveyed by the waste toner discharging screw 210 in the waste toner conveying path 220, and is then stored in the waste developer storing section 126*a* through the opening 124*a* and opening 135.

The supply developer 102 stored in the supply developer storing section 126*b* in the developer cartridge 125 is conveyed to the developer supply member 110 through the opening 136 communicated to the supply developer storing section 126*b* by rotating the developer conveying and agitating member 111. A necessary amount of the supply developer 102 is supplied into the developer housing 105 by rotating the developer supply member 110 based on the volume of copy or print sheets. As a result, the density of the developer 101 in the developer housing 105 is maintained at a predetermined density.

When the supply developer 102 is depleted from the supply developer storing section 126*b* after the image forming operations are repeatedly performed, the developer cartridge 125 needs to be replaced with a new developer cartridge. In the present embodiment, the developer cartridge 125 is integrally constructed with the waste developer storing section 126*a* and the supply developer storing section 126*b*, and is detachably attached to the developer supply container 124. When replacing the developer cartridge 125, the developer cartridge 125 is pulled out from the developer supply container 124 and is replaced with a new developer cartridge 125.

The new developer cartridge 125 is constructed with the supply developer storing section 126*b* filled with the supply developer, and the empty waste developer storing section 126*a*. By replacing the developer cartridge 125, the waste developer storing section 126*a* is removed from the main body of the image forming apparatus together with the supply developer storing section 126*b*. Therefore, the excess developer 101*a* and the waste toner can be removed from the main body of the image forming apparatus and disposed of without performing an independent disposal operation.

Figure 6:
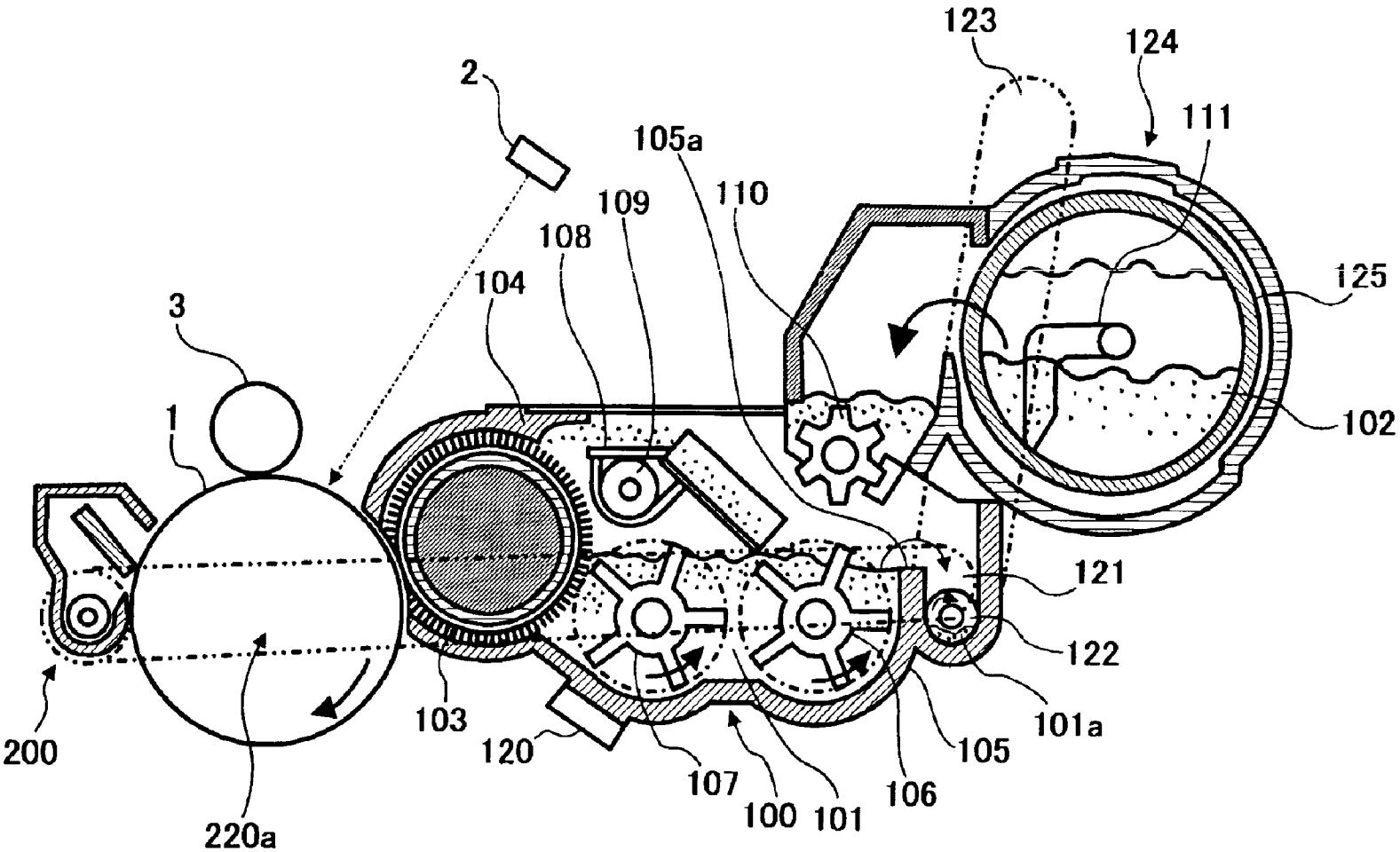
FIG. 6 is a schematic view of an image forming section of an image forming apparatus according to another embodiment of the present invention.
Figure 7A:
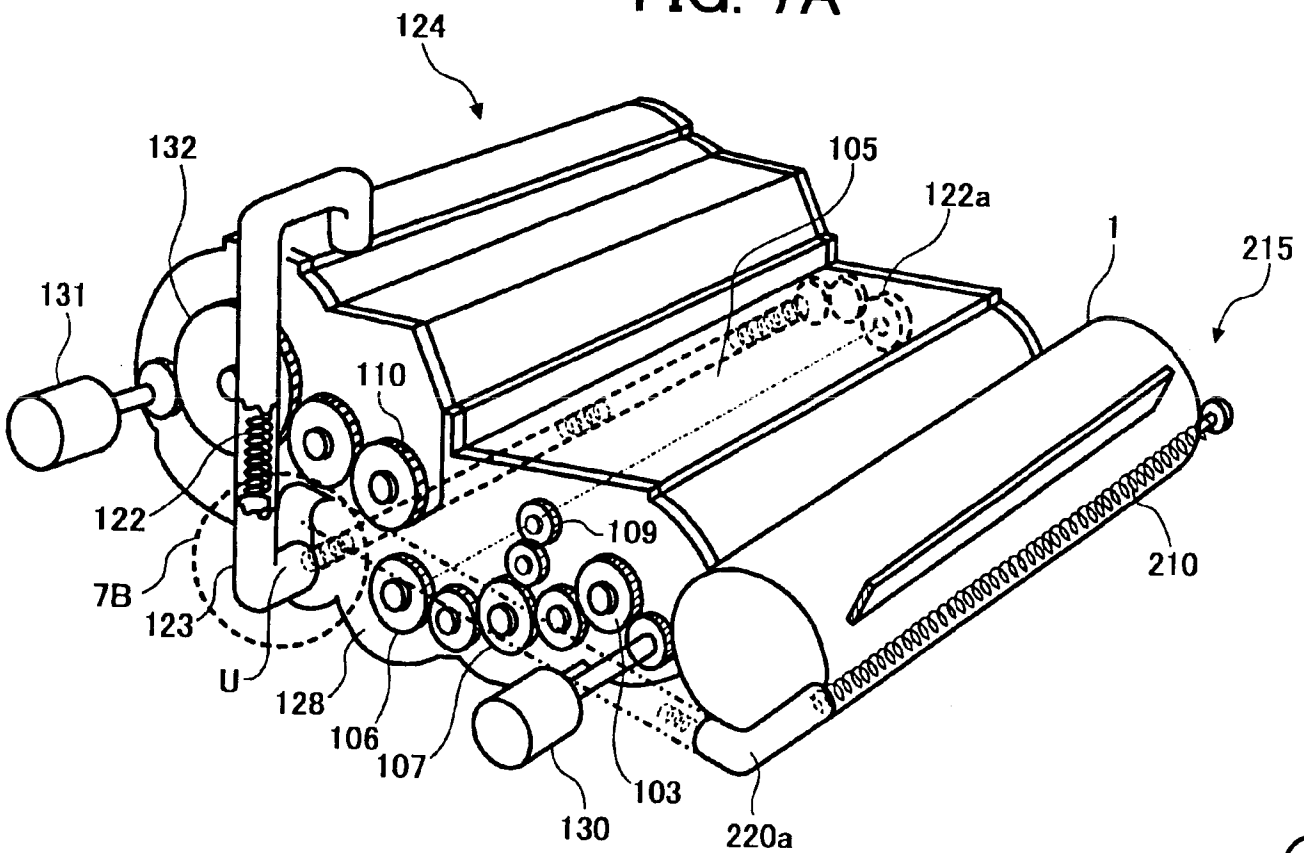
FIG. 7A is a perspective view of a part of the image forming section of the image forming apparatus of FIG. 6.
Figure 7B:
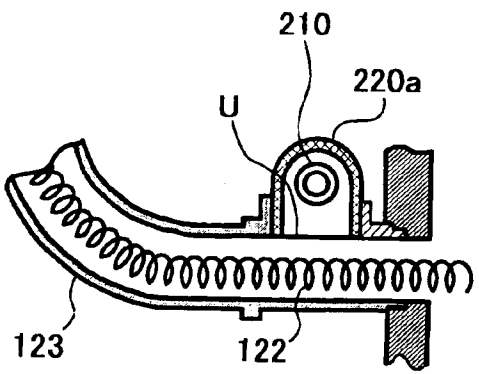
FIG. 7B is an enlarged view of a merged position of a waste toner conveying path and an excess developer conveying path.

Turning now to FIG. 6, which is a schematic view of an image forming section of an image forming apparatus according to another embodiment of the present invention. FIG. 7A is a perspective view of a part of the image forming section of the image forming apparatus of FIG. 6, and FIG. 7B is an enlarged view of a merged position of a waste toner conveying path and an excess developer conveying path. The configuration of the image forming section of FIG. 6 is similar to that of the image forming section of FIG. 1, except for a waste toner conveying path through which the waste toner removed from the surface of the photoconductive drum 1 by the cleaning device 200 is conveyed to the waste developer storing section 126*a*.

In the image forming apparatus of FIG. 1, the waste toner conveying path 220 is directly connected to the waste developer storing section 126*a*. However, in this embodiment, a waste toner conveying path 220*a* merges with the excess developer conveying path 123 as illustrated in FIGS. 6 and 7A. FIG. 7B shows a specific construction of a part of the waste toner conveying path 220*a* merged into the excess developer conveying path 123.

As illustrated in FIGS. 7A and 7B, the waste toner conveying path 220*a* is merged with the upper portion of the excess developer conveying path 123 at a merged position (U). The waste toner having passed through the waste toner conveying path 220*a* to the merged position (U) falls to the inside of the excess developer conveying path 123, and is conveyed to the waste developer storing section 126*a* through the excess developer conveying path 123. The excess developer is conveyed to the waste developer storing section 126*a* through the excess developer conveying path 123 similarly as in the image forming apparatus of FIG. 1.

In the image forming apparatus according to the present embodiment, the number of the connection part of the excess developer conveying path 123 and the waste toner conveying path 220*a* to the waste developer storing section 126*a* can be single. That is, the number of the above-described connection part to the developer cartridge 125 including the waste developer storing section 126*a* can be single. As described above, the developer cartridge 125 is configured to be detachably attached to the developer supply container 124. Therefore, the excess developer/waste toner conveying path is configured to be detachably attached to the developer cartridge 125 as well. In this configuration, an undesired gap tends to be formed at the connecting part of the excess developer conveying path 123 and the waste toner conveying path 220*a* to the waste developer storing section 126*a*, so that the supply developer, the excess developer, and the waste toner stored in the developer cartridge tend to be scattered from the developer cartridge 125 (hereafter referred to as "toner scattering") through the gap at the connecting part.

Accordingly, in the present embodiment, the toner scattering can be prevented as compared to the image forming apparatus of FIG. 1 which has two connection parts, i.e., one connection part of the excess developer conveying path 123 and another connection part of the waste toner conveying path 220 to the waste developer storing section 126*a*.

In addition, because the excess developer/waste toner conveying path needs to be detachably attached to the developer cartridge 125, the assembly of the image forming section can be more facilitated with one excess developer/waste toner conveying path instead of two conveying paths. Furthermore, in this embodiment, the waste toner conveying path 220*a* is merged with the excess developer conveying path 123 at a substantially middle portion of the excess developer conveying path 123, i.e., at the merged position (U), so that the excess developer and waste toner mixed together are conveyed in the excess developer conveying path 123 after the merged position (U). In this configuration, the entire length of the excess developer conveying path 123 and the waste toner conveying path 220*a* can be reduced. As a result, the size of the image forming apparatus can be reduced.

As described above, in this embodiment, the waste toner conveying path 220*a* is merged with the excess developer conveying path 123 that connects to the waste developer storing section 126*a*. Alternatively, the excess developer conveying path 123 may be merged with the waste toner conveying path 220*a* that may connect to the waste developer storing section 126*a*.

In this embodiment, it is not necessary to increase the cross-sectional area of the part of the excess developer conveying path 123 downstream of the merged position (U) in the excess developer conveying direction. As the waste toner is continuously conveyed to the waste developer storing section 126*a* each time the waste toner is removed from the surface of the photoconductive drum 1, a large quantity of waste toner does not pass through the waste toner conveying path 220*a* and the excess developer conveying path 123 at one time. Therefore, the excess developer conveying path 123 has a cross-sectional area large enough to pass the excess developer. If the cross-sectional area of the excess developer conveying path 123 is increased, the additional area added to the cross-sectional area of the excess developer conveying path 123 may be less than the cross-sectional area of the waste toner conveying path 220 in the image forming section of FIG. 1.

Thus, in the image forming section of FIGS. 6 and 7A, the number of the connection part of the excess developer conveying path 123 and the waste toner conveying path 220*a* to the developer cartridge 125 including the waste developer storing section 126*a* is single. Therefore, the size of the connection part can be reduced, and the developer and waste toner can be prevented from scattering through the connection part.

In the above-described embodiments, the waste developer storing section 126*a* that stores the excess developer and waste toner is provided in the developer cartridge 125. If an excess developer storing section and a waste toner storing section are provided independently in the main body of the image forming apparatus, each space for the excess developer storing section and the waste toner storing section is necessary, thereby increasing the size of the main body of the image forming apparatus. In a background image forming apparatus in which an excess developer storing section and a waste toner storing section are provided independently in the main body thereof, the disposal operation of a waste developer such as an excess developer and waste toner is generally performed by a serviceman at a predetermined timing. In this case, such a disposal operation is not performed easily and frequently, so that the section for storing a waste developer may be designed to be large enough to store the waste developer until a serviceman disposes of the waste developer. As a result, the size of the image forming apparatus tends to increase.

In the above-described embodiments, by replacing the developer cartridge 125 with a new developer cartridge, the excess developer and waste toner can be easily removed from the main body of the image forming apparatus and can be disposed of without performing an independent disposal operation. As a result, the waste toner disposal operation can be performed by the user instead of a serviceman. Further, the downtime of the image forming apparatus caused by the disposal operation of the excess developer and waste toner can be prevented.

The above-described image forming apparatus includes a single developing device and forms single-color images. However, the image forming apparatus may include a plurality of developing devices and form multi-color images. As compared to a single-color image forming apparatus, a multi-color image forming apparatus consumes a large quantity of toner. Generally, the multi-color image forming apparatus includes a plurality of developing devices and forms a copy or print of a color original document in which an image occupation area is relatively large. Accordingly, in this type of a multi-color image forming apparatus, the large amount of excess (fatigued) developer and waste toner is discharged from the multi-color image forming apparatus. Therefore, it is advantageous to apply the features of the present invention to the multi-color image forming apparatus.

The present invention has been described with respect to the embodiments as illustrated in the figures. However, the present invention is not limited to the embodiment and may be practiced otherwise.

Numerous additional modifications and variations of the present invention are possible in light of the teachings. It is therefore to be understood that within the scope of the appended claims, the present invention may be practiced otherwise than as specifically described herein.

What is claimed:

1. An image forming apparatus including a main body, comprising:

an image carrier configured to carry a latent image on a surface of the image carrier;

a developing device configured to develop the latent image on the image carrier with a developer including toner and carrier and to form a toner image on the surface of the image carrier;

a transfer device configured to transfer the toner image from the image carrier to a transfer material;

a cleaning device configured to remove a waste toner remaining on the surface of the image carrier after the toner image is transferred from the image carrier to the transfer material by the transfer device;

a developer supply device configured to supply the developer to the developing device;

a developer discharging device configured to discharge an excess developer from the developing device;

a developer containing device configured to contain the developer to be supplied to the developing device by the developer supply device, the developer containing device including;

an opening facing the developer supply device;

a developer storing section configured to store the developer supplied to the developer supply device through the opening; and a waste developer storing section configured to store the excess developer discharged from the developing device by the developer discharging device and to store the waste toner removed from the surface of the image carrier by the cleaning device, wherein at least the image carrier, the developing device, the developer supply device, and the developer containing device are positioned substantially parallel to each other, and the developer containing device is detachably attached to the main body of the image forming apparatus, and when the developer containing device is detached from the main body of the image forming apparatus for replacement of the developer containing device by a new developer containing device, the waste developer storing section is configured to be detached from the main body of the image forming apparatus together with the developer containing device.

2. The image forming apparatus according to claim 1, wherein the developer containing device is formed from a cartridge.

3. The image forming apparatus according to claim 2, further comprising, an excess developer conveying device configured to convey the excess developer discharged from the developing device by the developer discharging device to the waste developer storing section; and a waste toner conveying device configured to convey the waste toner removed from the surface of the image carrier by the cleaning device to the waste developer storing section.

4. The image forming apparatus according to claim 2, further comprising:

an excess developer conveying device configured to convey the excess developer discharged from the developing device by the developer discharging device to the waste developer storing section; and a waste toner conveying device configured to convey the waste toner removed from the surface of the image carrier by the cleaning device;

wherein the waste toner conveying device is merged with the excess developer conveying device, and the excess developer conveying device is configured to convey the excess developer and waste toner to the waste developer storing section after the waste toner conveying device is merged with the excess developer conveying device.

5. The image forming apparatus according to claim 3, wherein the excess developer conveying device and the waste toner conveying device are provided at one side of the image carrier, the developing device, the developer supply device, and the developer containing device.

6. The image forming apparatus according to claim 4, wherein the excess developer conveying device and the waste toner conveying device are provided at one side of the image carrier, the developing device, the developer supply device, and the developer containing device.

7. An image forming apparatus including a main body, comprising:

image carrying means for carrying a latent image on a surface of the image carrying means;

developing means for developing the latent image on the image carrying means with a developer including toner and carrier and for forming a toner image on the surface of the image carrying means;

transferring means for transferring the toner image from the image carrying means to a transfer material;

removing means for removing a waste toner remaining on the surface of the image carrying means after the toner image is transferred from the image carrying means to the transfer material by the transferring means;

developer supplying means for supplying the developer to the developing means;

developer discharging means for discharging an excess developer from the developing means;

developer containing means for containing the developer to be supplied to the developing means by the developer supplying means, the developer containing means including;

an opening facing the developer supplying means;

developer storing means for storing the developer supplied to the developer supplying means through the opening; and waste developer storing means for storing the excess developer discharged from the developing means by the developer discharging means and for storing the waste toner removed from the surface of the image carrying means by the removing means;

wherein at least the image carrying means, the developing means, the developer supplying means, and the developer containing means are positioned substantially parallel to each other, and the developer containing means is detachably attached to the main body of the image forming apparatus, and when the developer containing means is detached from the main body of the image forming apparatus for replacement of the developer containing means by new developer containing means, the waste developer storing means is detached from the main body of the image forming apparatus together with the developer containing means.

8. The image forming apparatus according to claim 7, wherein the developer containing means is formed from a cartridge.

9. The image forming apparatus according to claim 8, further comprising, excess developer conveying means for conveying the excess developer discharged from the developing means by the developer discharging means to the waste developer storing means; and waste toner conveying means for conveying the waste toner removed from the surface of the image carrying means by the removing means to the waste developer storing means.

10. The image forming apparatus according to claim 8, further comprising:

excess developer conveying means for conveying the excess developer discharged from the developing means by the developer discharging means to the waste developer storing means; and waste toner conveying means for conveying the waste toner removed from the surface of the image carrying means by the removing means;

wherein the waste toner conveying means is merged with the excess developer conveying means, and the excess developer conveying means conveys the excess developer and waste toner to the waste developer storing means after the waste toner conveying means is merged with the excess developer conveying means.

11. The image forming apparatus according to claim 9, wherein the excess developer conveying means and the waste toner conveying means are provided at one side of the image carrying means, the developing means, the developer supplying means, and the developer containing means.

12. The image forming apparatus according to claim 10, wherein the excess developer conveying means and the waste toner conveying means are provided at one side of the image carrying means, the developing means, the developer supplying means, and the developer containing means.

* * * * *